United States Patent [19]

Yokoi

[11] 4,376,537

[45] Mar. 15, 1983

[54] ROTARY PUZZLE DEVICE

[75] Inventor: Gunpei Yokoi, Kyoto, Japan

[73] Assignee: Nintendo Co., Ltd., Kyoto, Japan

[21] Appl. No.: 221,292

[22] Filed: Dec. 30, 1980

[30] Foreign Application Priority Data

Oct. 23, 1980 [JP] Japan ..... 55-148562
Nov. 25, 1980 [JP] Japan ..... 55-166069

[51] Int. Cl.[3] ..... A63F 9/08
[52] U.S. Cl. ..... 273/153 S; 273/113
[58] Field of Search ..... 273/153 S, 113, 115; 434/174

[56] References Cited

U.S. PATENT DOCUMENTS

| | | | |
|---|---|---|---|
| 509,362 | 11/1893 | Casler | 273/115 |
| 606,030 | 6/1898 | Rowell | 273/113 |
| 679,782 | 8/1901 | Reenstierna | 273/113 |
| 785,665 | 3/1905 | Coe | 273/153 S |
| 3,239,951 | 3/1966 | Benson | 434/174 |
| 3,610,628 | 10/1971 | Promin | 273/138 R |
| 4,208,052 | 6/1980 | Snow | 273/153 S |

*Primary Examiner*—Anton O. Oechsle
*Attorney, Agent, or Firm*—Koda and Androlia

[57] ABSTRACT

A puzzle game device with which one tries to solve a puzzle by shifting puzzle elements. The puzzle game device includes a rotary indicator having puzzle holes, a shunting body having at least one shunting hole and puzzle elements. The rotary indicator is rotatable correlatively to the shunting body. Puzzle indication can be changed by shifting puzzle elements in the rotary indicator into other puzzle holes through the medium of shunting holes of the shunting body.

6 Claims, 31 Drawing Figures

3a
3f
3e
3c
3b
3d
13
14B
2B
1B
3
1A
2A
14A

ROTARY PUZZLE DEVICE

BACKGROUND OF THE INVENTION

1. Field of the Invention

This invention relates to a puzzle game device and more particularly, to a game device with which one tries to solve a puzzle by shifting puzzle elements.

2. Prior Art

With regard to puzzle game devices of this kind, a picture puzzle is well known. According to this picture puzzle, one picture or a game board is divided into many sections, for example three in each row and file or 9 sections in total, and square pieces indicating each section of the picture are puzzle elements. Therefore, puzzle elements are separate from each other and also separate from a game board. In this structure, there occurs a problem in that puzzle elements are lost. Moreover, the picture puzzle is solved in a simple way and does not provide different levels of challenging in solving a puzzle.

In general puzzle games, our experience shows that if the game is easy to solve, players learn easily the way of solving the puzzle and soon lose interest in it; on the contrary if the game is difficult to solve players give it up soon and lose the will to try the game. Therefore, if the game does not provide different levels of challenging in solving a puzzle as in the case of the above-mentioned picture puzzle, users of such puzzle devices are limited by ages and faculty and mass sales of such puzzle devices are impossible.

SUMMARY OF THE INVENTION

An object of the present invention is to provide a puzzle game in which a plurality of solutions, varying in the degree of difficulty of solving, are available according to the ability of game players.

Another object of the present invention is to provide a puzzle game device for a puzzle game by changing the arrangement of puzzle elements by moving replaceable puzzle elements, wherein puzzle elements are enclosed in the device to prevent loss of them and progress of the game is made difficult by moving plural puzzle elements with the movement of a specific puzzle element, thereby enhancing the utility value of the puzzle game device of this kind.

Still another object of the present invention is to provide a puzzle game device, wherein arrangement of puzzle elements is changed by moving puzzle elements enclosed in puzzle holes by simple manual operation by a user and thus means and operation of changing the arrangement of puzzle elements is simplified.

A further object of the present invention is to provide a rotary puzzle device characterized in that it includes a plurality of rotary indicators having puzzle holes and shunting bodies having shunting holes which are communicant with puzzle holes of said rotary indicators and are rotatable correlatively to said rotary indicators, carries out puzzle indication by the arrangement of puzzle elements inserted in plural puzzle holes of said rotary indicators and changes puzzle indication by shifting puzzle elements in the rotary indicator into other puzzle holes through the medium of shunting holes of the shunting body.

A still further object of the present invention is to provide a rotary puzzle characterized in that the number of groups of puzzle elements, the number of puzzle elements in each group and the total number of puzzle elements are selected so that arrangement of puzzle elements of each group in the puzzle holes in each direction is made the solution to the puzzle.

A still further object of the present invention is to provide a rotary puzzle device characterized in that it includes a rotary indicator having puzzle holes and a shunting body having at least two shunting holes and being rotatable correlatively to said rotary indicator, whereby at least two puzzle elements accommodated in different puzzle holes are shifted to other puzzle holes simultaneously, with the result that with the change of puzzle indication by one specified puzzle hole, puzzle indications by some or all of the other puzzle holes are changed.

Another object of the present invention is to provide a rotary puzzle device comprising at least one rotary indicator of drum shape having at least two puzzle holes which pass through the circumferential part of said rotary indicator in axial direction, a pair of shunting bodies which are rotatable correlatively to said rotary indicator and have at least one shunting hole passing therethrough at the position where it is communicant with the puzzle holes of said rotary indicator, many puzzle elements filled in all puzzle holes of said rotary indicator and in shunting holes of shunting bodies, and a puzzle elements moving means having a pair of support discs located outwardly of said pair of shunting rotary bodies and with projections or plungers, in the same number as the shunting holes of one shunting body, projecting toward shunting holes of the shunting body and a shaft passing through centers of said rotary indicator and said shunting rotary bodies for integrating said pair of support discs into one, wherein the distance between projections or plungers of said pair of support discs is made almost equal to the total length of puzzle elements which are located between a pair of opposing shunting holes plus the length equal of one puzzle element so that when one puzzle element in one shunting hole is pushed in a puzzle hole, one puzzle element in a puzzle hole is shifted into the opposite shunting hole which is vacant.

The nature and characteristics of the present invention will be understood more clearly from the following descriptions made with reference to the accompanying drawings.

BRIEF DESCRIPTION OF THE DRAWINGS

FIG. 12 and FIG. 13 are rough sketches, each showing an embodiment of the present invention in the case where all puzzle elements are individualized by specific numerals or the like;

FIG. 14 is a perspective view almost the same as FIG. 1;

FIG. 15 is a perspective view almost the same as FIG. 2;

FIG. 16 is a longitudinal section, taken on the line $S_{16}$—$S_{16}$ of FIGS. 17 and 18, almost the same as FIG. 3;

FIG. 17 is a cross section, taken on the line $S_{17}$—$S_{17}$ of FIG. 14, almost the same as FIG. 4;

FIG. 18 is a cross section, taken on the line $S_{18}$—$S_{18}$ of FIG. 14;

FIG. 19 is a plan view showing an embodiment of the present invention wherein the rotary indicator is a flat disc shape, almost the same as FIG. 9;

FIG. 20 is a rough sketch showing the movement of puzzle elements, FIG. 20(*a*) showing the state before working of a plunger of a puzzle elements moving means, FIG. 20(*b*) showing the state after working of the plunger and FIGS. 20(*c*) and 20(*d*) showing the state after movement of a rotary indicator; and FIG. 21 is rough sketches showing an embodiment of the present invention in the case where all puzzle elements are individualized by specific numerals or the like, almost the same as FIG. 12.

DETAILED DESCRIPTION OF THE INVENTION

Figure 1:
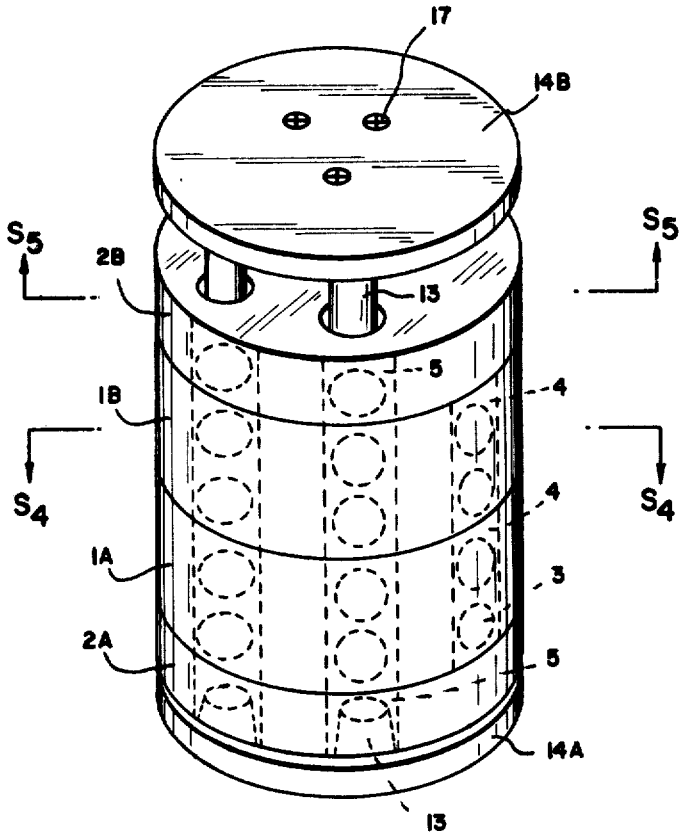
FIG. 1 is a perspective view of a rotary drum puzzle according to the present invention.
Figure 2:
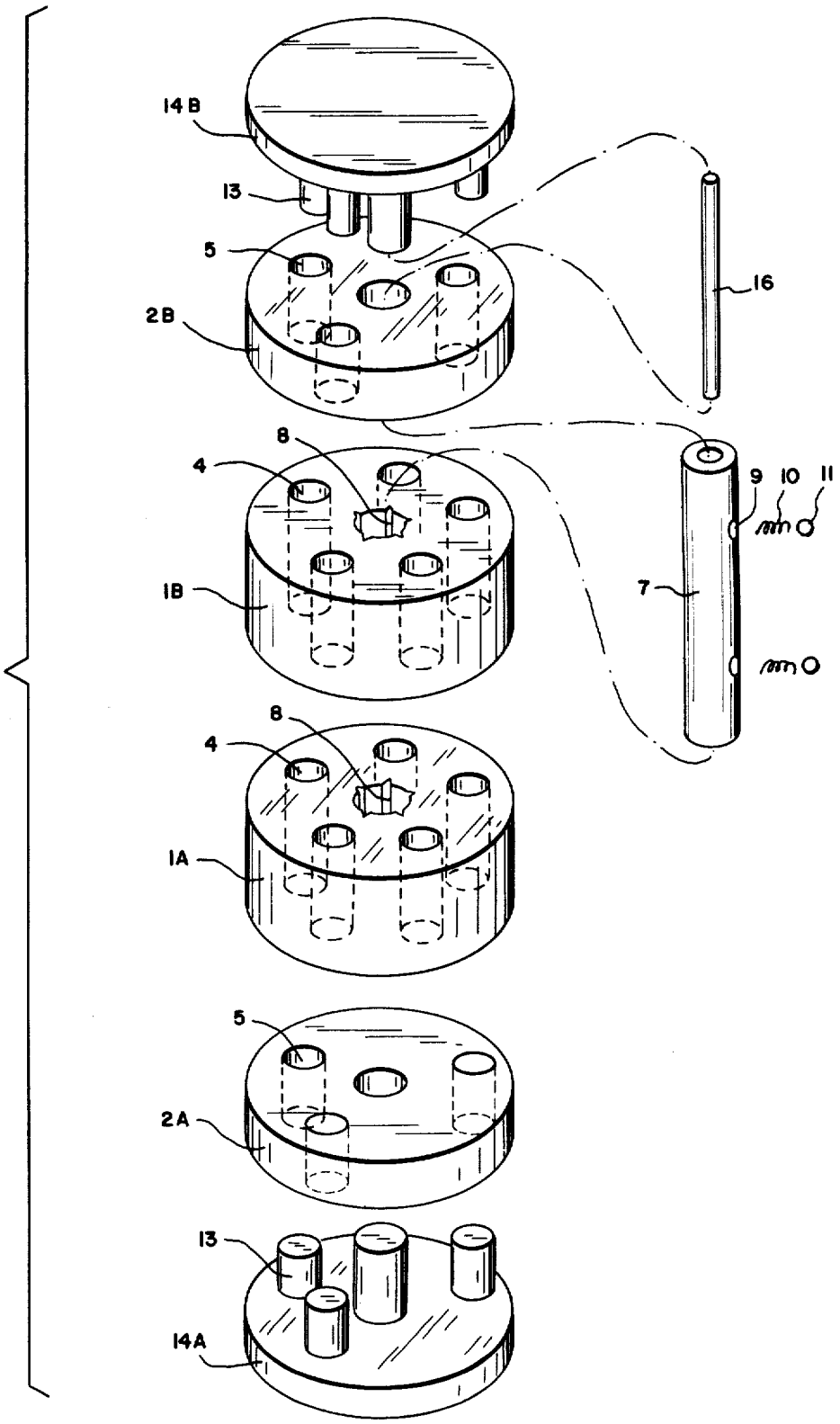
FIG. 2 is a perspective view of the rotary drum puzzle shown in FIG. 1, as it is disassembled.
Figure 3:
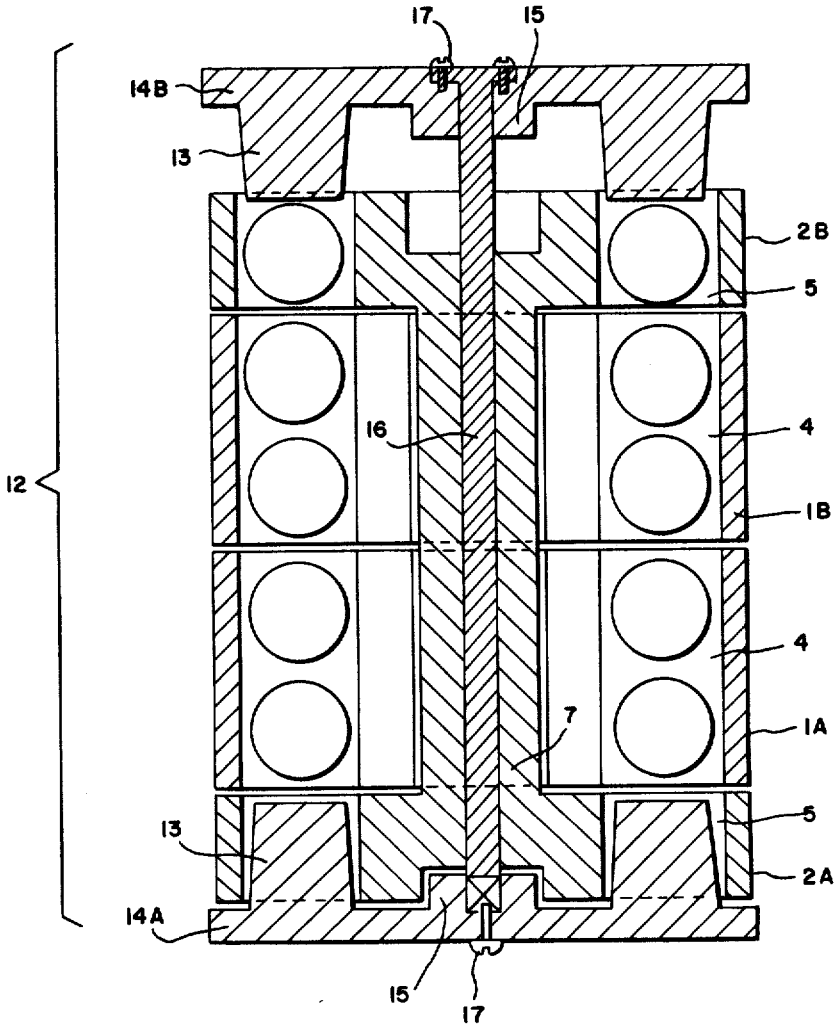
FIG. 3 is a longitudinal section, taken on the line $S_3$—$S_3$ of FIG. 4 and FIG. 5.
Figure 4:
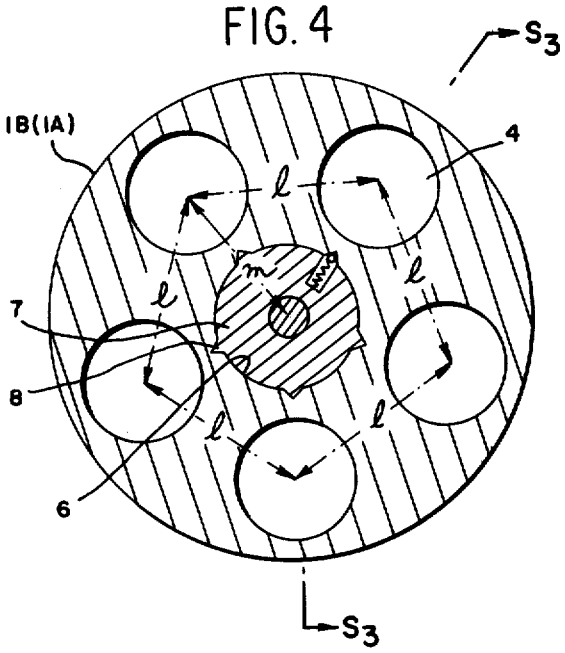
FIG. 4 is a cross section, taken on the line $S_4$—$S_4$ of FIG. 1.
Figure 5:
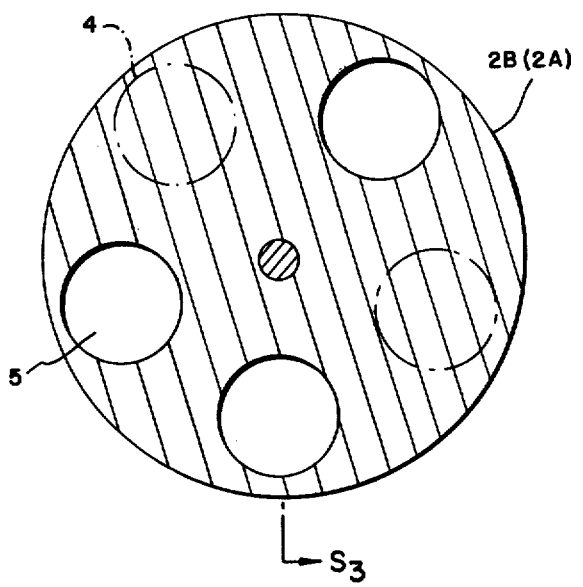
FIG. 5 is a cross section, taken on the line $S_5$—$S_5$ of FIG. 1.

Referring to FIG. 1, FIG. 2 and FIG. 3 showing an embodiment of the present invention, a rotary drum puzzle includes two rotary drum indicators 1 and two shunting bodies 2, each made of transparent synthetic resin. Puzzle elements 3 are small balls of five different colors, namely, in red, orange, yellow, green and white. Puzzle holes 4 and shunting holes 5 in which puzzle elements are accommodated are of cylindrical shape with a diameter slightly larger than that of the puzzle elements so as to make the latter slidable in the former. The puzzle hole 4 is long enough to hold two puzzle elements therein but the shunting hole 5 has a length to hold only one puzzle element therein.

The rotary drum puzzle according to the present invention is not limited to the above composition; for example, the rotary drum indicator 1 can be only one or, on the contrary, three or more; the puzzle hole 4 can be of such size that it accommodates only one puzzle element therein, or on the contrary, three or more; the puzzle element can be a polyhedron, a cube, a column or the like, instead of a small ball; and both the puzzle hole 4 and the shunting hole 5 can be in proper cross sectional shape, instead of the columnar shape.

At least three puzzle holes are made along the circumferential part of the rotary drum indicator 1 in polygonal arrangement such that the lines connecting the center lines of puzzle holes 4 form a polygon—a pentagonal arrangement in embodiments shown in FIGS. 1 through 5. Both the space l between centers of the puzzle holes 4 and the space m between the center of the rotary drum indicator 1 and the center of the puzzle hole 4 are made uniform.

Figure 6:
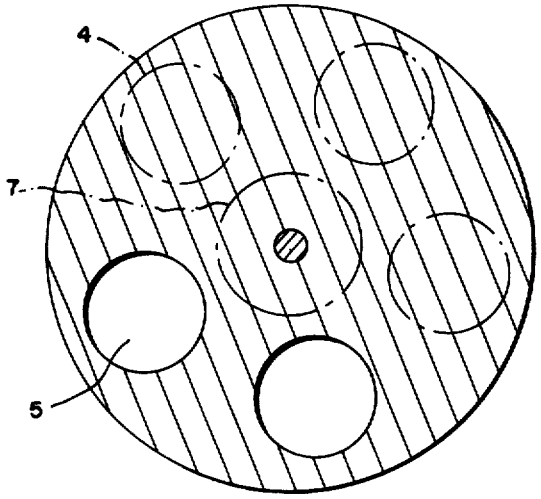
FIG. 6 and FIG. 7 show cross sections of other embodiments of a shunting body.
Figure 7:
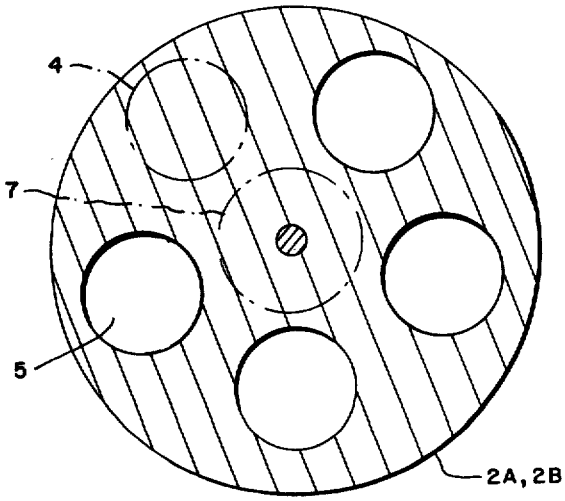
Figure 8A:
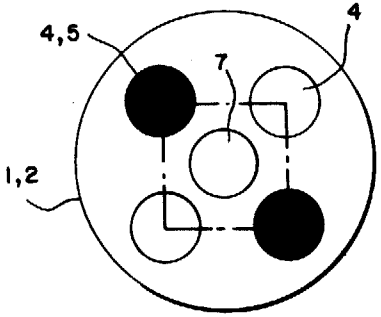
FIGS. 8*a* through 8*f* show further other embodiments of a shunting rotary body, indicating the relation between the locations of shunting holes and puzzle holes.
Figure 8B:
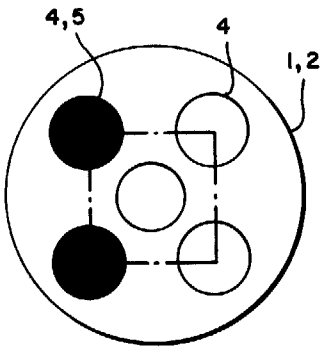
Figure 8C:
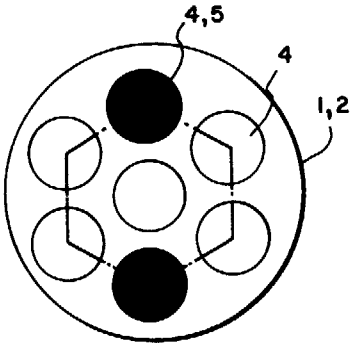
Figure 8D:
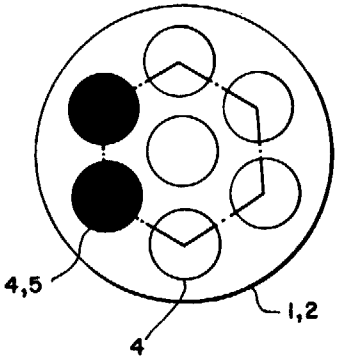
Figure 8E:
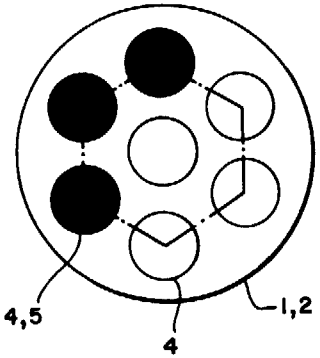
Figure 8F:
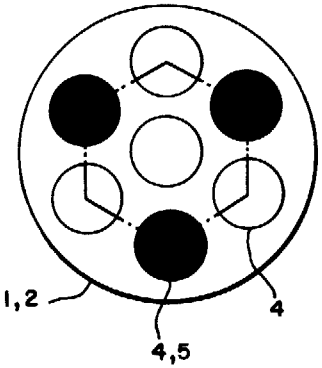

At least two shunting holes 5 are made along the circumferential part of the shunting body 2. In the embodiment shown in FIG. 5, three shunting holes including two which are adjoining each other are provided. In FIG. 6, only two shunting holes adjoining each other are provided but in FIG. 7 four shunting holes as against five puzzle holes of the rotary drum indicator 1 are made.

An axial hole 6 is made through the center of the rotary drum indicator 1. Passed through this axial hole 6 is a cylindrical body 7 which is fixed, at both ends thereof, to a pair (an upper and lower) of shunting bodies 2A and 2B so as to integrate both bodies 2A and 2B into one. The rotary drum indicators 1A and 1B are rotatable correlatively to the shunting body 2 and also rotatable reciprocally. Shunting holes 5 of both shunting bodies 2A and 2B are opposite to each other.

Grooves of the same number as the puzzle holes 4 of one rotary drum indicator 1 are made in the axial hole wall 6 of rotary drum indicators 1A and 1B. A spring 10 and a ball 11 are inserted in a hole 9 made in the cylindrical body 7 in radial direction relative to rotary drum indicators 1A and 1B. The relative angle of rotary drum indicators 1A and 1B to the shunting rotary body is made 360°/5 at five portions so that the puzzle holes 4 of the rotary drum indicators 1A and 1B and the shunting holes 5 of the upper and the lower shunting bodies 2A and 2B can take a straight line-like shape. Thus, movement of puzzle elements from the puzzle hole to the shunting hole and vice versa are made easy.

The object of the present invention can be achieved with puzzle elements 3 filled in puzzle holes 4 only but in the embodiment puzzle elements are filled in all puzzle holes 4 and all shunting holes 5 of the shunting body on one side 2A with no puzzle element in all puzzle holes 5 of the shunting body on the other side 2B.

For shifting a puzzle element 3 in lengthwise direction or axial direction from a puzzle hole 4 to a shunting hole 5 or from a shunting hole 5 to a puzzle hole 4, by turning a rotary puzzle at an angle of 180° (turning a rotary puzzle upside down) make the vacant shunting hole 5 among the two shunting holes 5 of a pair of shunting bodies 2A and 2B downward, whereupon the lowermost puzzle element 3 in the puzzle hole communicating with the vacant shunting hole 5 drops and enters in said vacant shunting hole 5 and the puzzle element in the shunting hole 5 of the upper shunting rotary body 2B drops in the puzzle hole 5 communicating therewith and thus the shunting hole 5 of the upper shunting rotary body 2B becomes vacant. Upon dropping of the lowermost puzzle element in the vacant shunting hole 5 which has become underside, puzzle elements in a line drop by one stage. Shifting of puzzle elements 3 in circumferential direction is effected by rotating manually the rotary indicators 1A and 1B relative to the shunting bodies 2A and 2B. Therefore, shifting of the puzzle elements 3 can be done without using a special driving means, but in the embodiment a driving means 12 for shifting puzzle elements 3 compulsorily in vertical direction (in axial direction of the rotary indicator) is provided.

This driving mechanism 12 comprises discs 14A and 14B provided above and below the shunting bodies 2A and 2B respectively. Each of these discs have projections 13, in the same number as shunting holes of one rotary drum indicator 1, which are slightly smaller in diameter than the shunting hole 5 and can get in and out of the shunting hole 5. In the position where the projection 13 of the lower disc 14A is located in the shunting hole 5 of the shunting body 2A so as to prevent the entering of a puzzle element 3 into the shunting hole 5 and a puzzle element 3 is allowed to stay in the upper shunting hole 5 due to existence of a gap n, slightly larger than the length of the puzzle element, namely, diameter of a small ball, between the upper surface of the shunting body 2B and the under surface of the disc 14B, a shaft 16 which is passed through a cylindrical body 7 is fixed, at both its ends, to boss parts 15, 15 by screws 17 or the like.

In the above embodiment, movement of puzzle elements 3 in circumferential direction by the rotation of one or both of the rotary drum indicators 1A and 1B and manipulation of the driving mechanism 12, rising or lowering of the disc 14A and the disc 14B, compose one game cycle. At each game cycle puzzle indications are varied to render the puzzle game difficult. However, in the case where an easy game is desired for school children or where a simpler manufacturing process is desired, it is advisable to make the number of shunting holes 5 equal to that of the puzzle holes 4 of one rotary drum indicator 1 or to arrange puzzle holes 4 in square, hexagonal, octagonal or other arrangement and arrange shunting holes 5 in such a fashion as shown by FIGS. 8(*a*), 8(*b*), 8(*c*), 8(*e*) and 8(*f*). In this case, the shunting hole 5 becomes a point symmetry or a linear symmetry to the center of the shunting body 2 and by only moving puzzle elements 3 in some of the puzzle holes, for example, ½ or ⅓ of puzzle holes, the desired puzzle elements can be moved to change the puzzle indication, especially in the case where the shunting hole 5 is a point symmetry to the center of the shunting rotary body and the shunting holes 5 are not adjoining each other as shown in FIG. 8(*a*), 8(*c*) and 8(*f*), moving of puzzle elements is possible by relative movement of blacks only, irrespective of the puzzle holes in white and thus puzzle elements can be changed easily to the desired arrangement.

Figure 9:
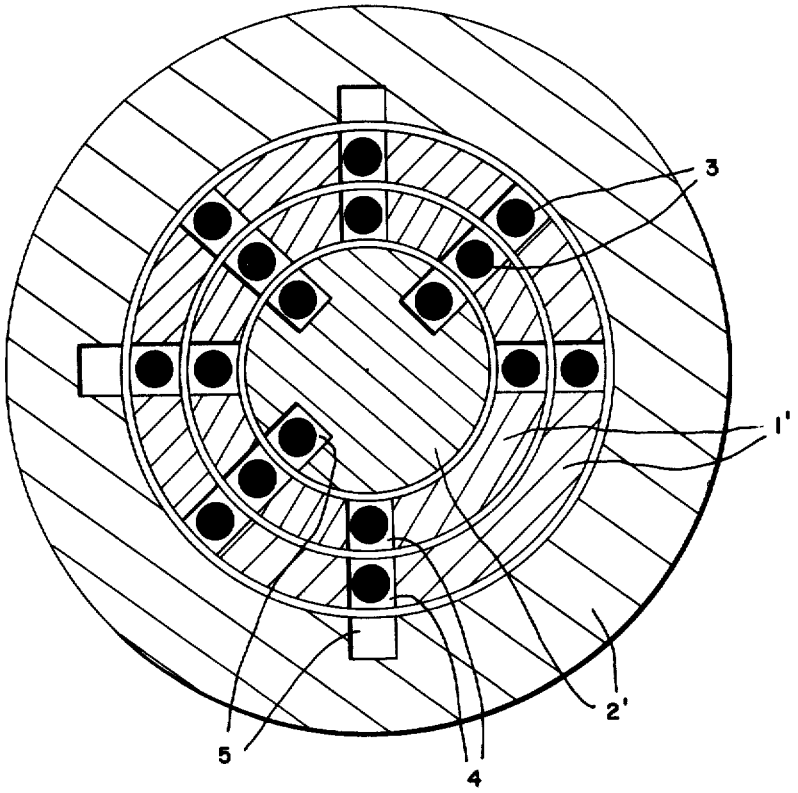
FIG. 9 is a plan view showing an embodiment of the present invention in the case where the rotary indicator is of flat disc shape.

In the above described embodiment, it is so designed that the rotary indicator 1 and the shunting body 2 are drum-shaped and the puzzle element 3 is movable both in axial direction and circumferential direction. However, as shown in FIG. 9, the object of the present invention can be achieved by such composition that the rotary indicator $1^1$ and the shunting body $2^1$ are made in doughnut-shape, both being concentric and having a different diameter, the puzzle hole 4 and and the shunting hole 5 are made in radial direction so that the puzzle element 3 can be moved both in radial direction and circumferential direction.

In the preceding embodiment, it is possible to fix a part of the rotary indicators $1^1$ and the shunting bodies $2^1$ or to provide only one shunting body $2^1$ at the inner center part or at the outer circumferential part.

Figure 10:
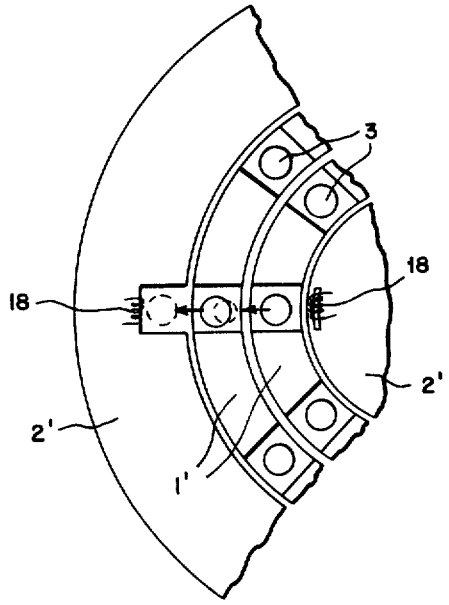
FIG. 10 is a rough sketch showing an electromagnet type driving mechanism.
Figure 11C:
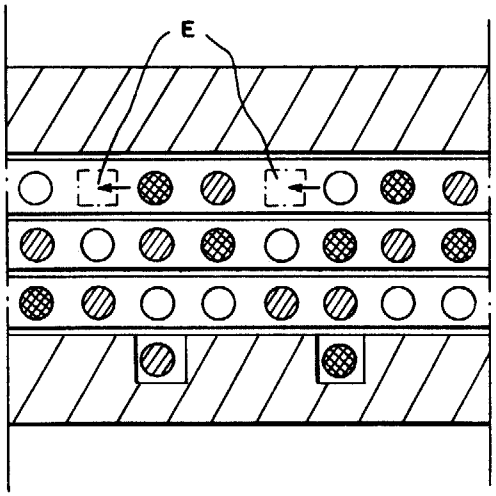
FIGS. 11*a* through 11*c* are rough sketches showing the movement of puzzle elements in the case where a shunting body is arranged on one side only, FIG. 11(*a*) showing the state before working of the electromagent, FIG. 11(*b*) showing the state after working of the electromagnet and FIG. 11(*c*) showing the state after movement of a rotary drum indicator.
Figure 11B:
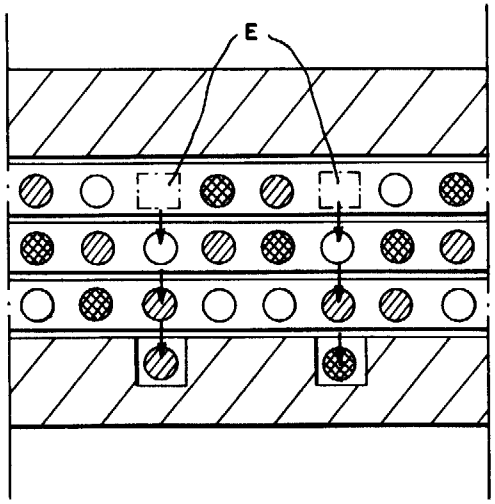
Figure 11A:
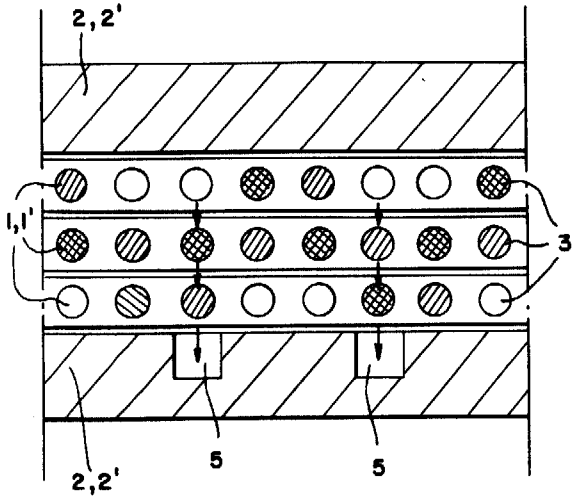

The driving mechanism can be of electromagnetic type or of mechanical type, instead of manual operation type. In the case where the shunting bodies 2, $2^1$ are provided only at the outer circumferential side and at the lower side respectively, dispensing with the shunting bodies 2, $2^1$ at the other side (inner center side and the upper side), the magnet 18 is provided at the position facing the shunting holes 5 of the shunting bodies 2, $2^1$ as shown in FIG. 11 and also, FIG. 10. Instead of the above magnet, it is possible to move the puzzle elements 3 by making a working piece to be actuated by solenoid or a working piece to work in linkage with the lever operation get in and get out of the shunting hole 5.

In the case where the shunting bodies 2, $2^1$ are provided only on one side, it is possible to make vacant rooms E face all shunting holes 5 and thereby enable puzzle elements 3 to move in circumferential direction and axial direction or radial direction with resultant change of the puzzle indication, by selecting the number of puzzle elements 3 to be filled in puzzle holes 4 so that there exist vacant rooms E, namely, holes in which puzzle elements are not present which number the same as or more than the shunting holes 5, as shown in FIG. 11.

Moreover, it is possible to make the rotary drum indicators 1, $1^1$ and the shunting bodies 2, $2^1$ large type for which the electro-motive rotation system is adopted. Especially in the embodiment shown in FIG. 9, it is suggested to turn one or more rotary indicators $1^1$ by button operation of electro-motive system, thus making the puzzle according to the present invention a large type puzzle device for use at the game center.

Puzzle elements comprise plural groups of red, blue, green . . . but it is possible to give numerals, symbols or the like, such as 1, 2, 3 . . . or A, B, C . . . to each group so as to individualize all puzzle elements, for example, puzzle elements at the outer circumferential side are yellow with 1, 2 . . . 12 and those at the inner circumferential side are white with 13, 14 . . . 24 in order to assume the form of the indicating board of clock.

The embodiment in FIGS. 14 through 18 is almost the same as that in FIGS. 1 through 5. The only difference between the two is that in respect of projection or plunger of discs 14A, 14B and shunting hole 5 of each of shunting bodies 2A, 2B, while the embodiment in FIGS. 1 through 5 has three (for each pair of discs 14A, 14B and shunting bodies 2A, 2B), the embodiment in FIGS. 14 through 18 has only one.

Figure 12:
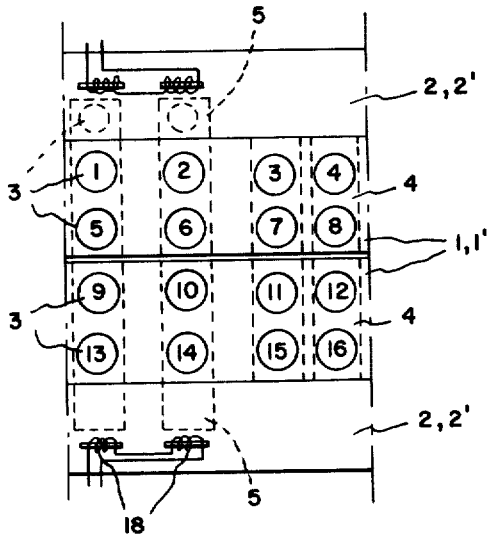
Figure 13:
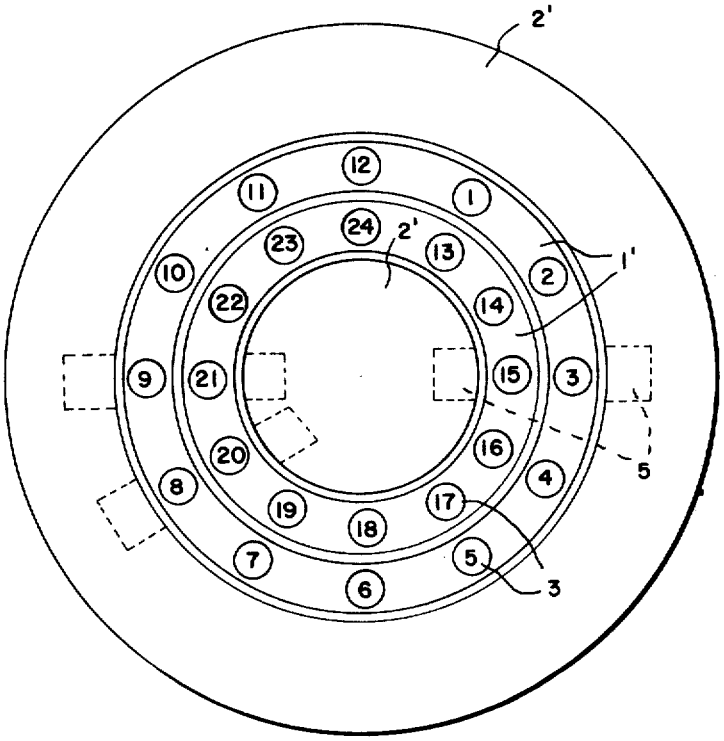
Figure 14:
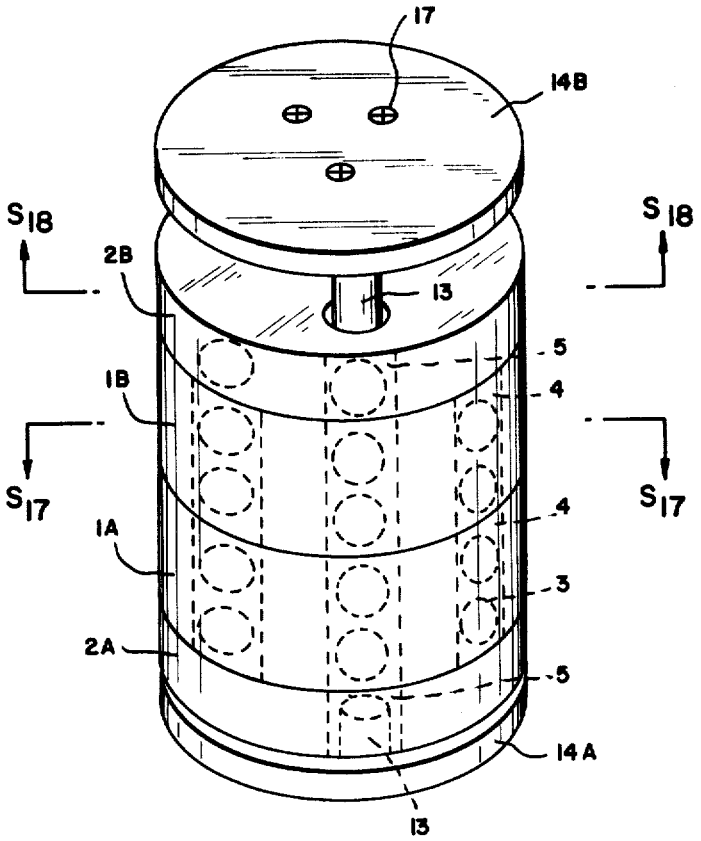
FIGS. 14 through 21 show other embodiments of the present invention in the case where shunting hole of shunting body is one.
Figure 15:
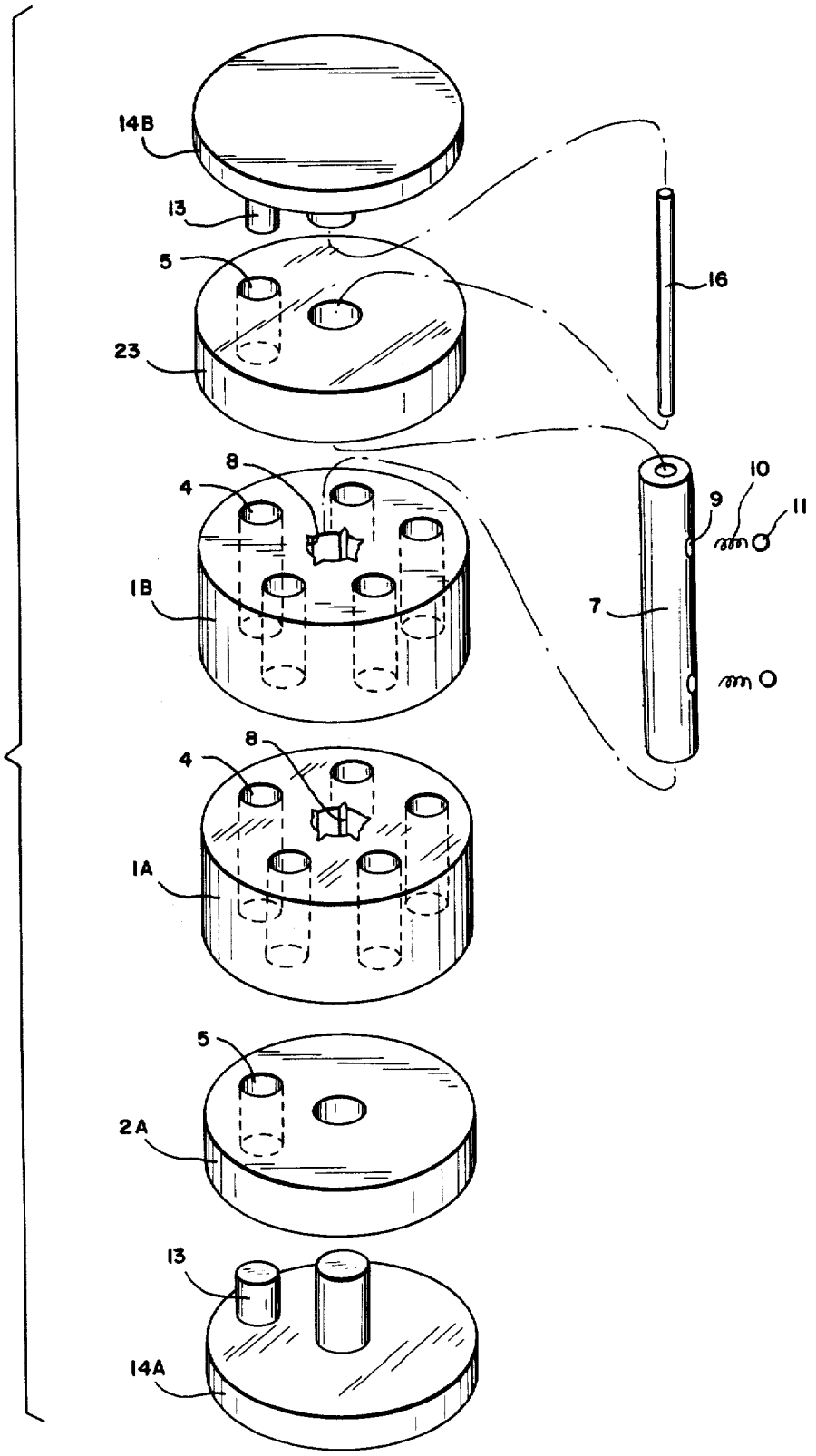
Figure 19:
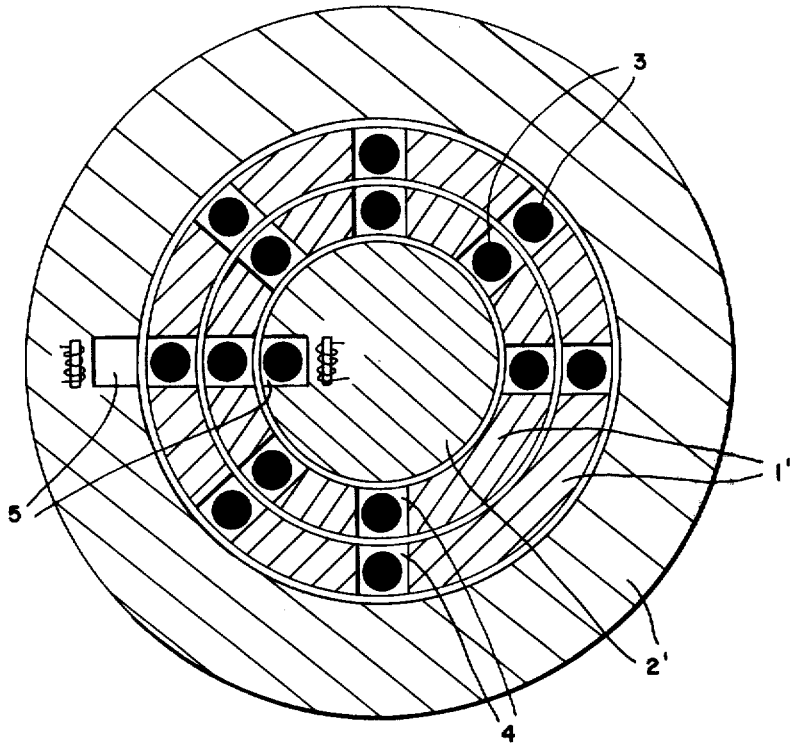
Figure 21:
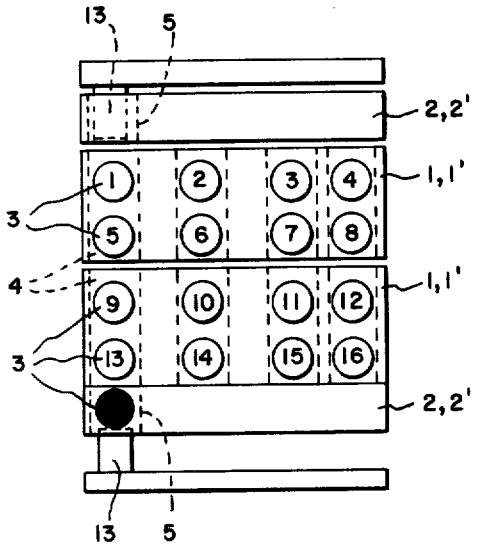

Referring to FIG. 19 and FIG. 21 which correspond to FIG. 9 and FIG. 12, the difference between the embodiment in FIG. 19 and FIG. 21 and that in FIG. 9 and FIG. 12 is that a pair of projections 13 and a pair of shunting holes are provided in the case of the latter.

Figure 17:
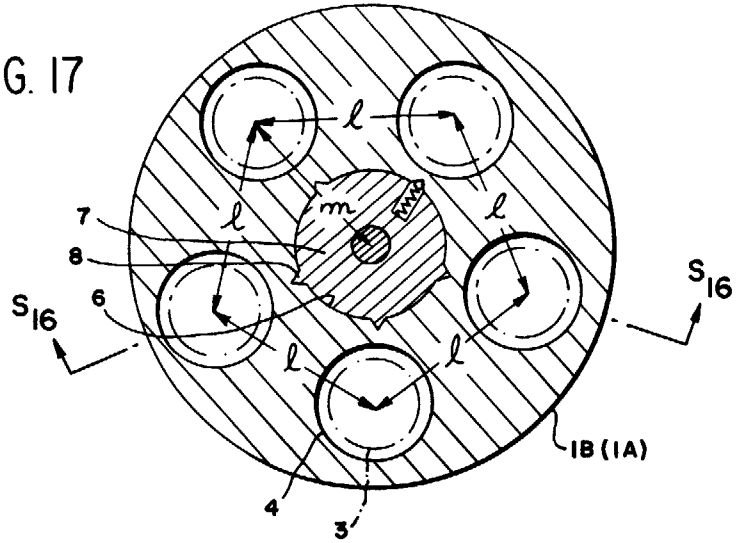
Figure 18:
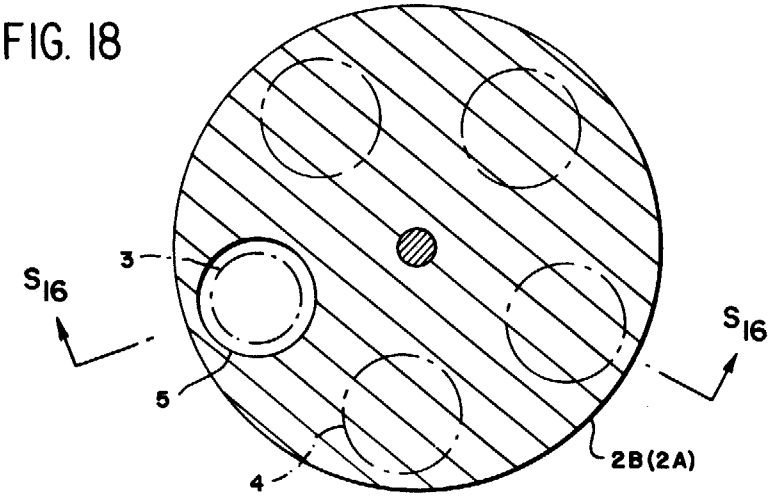
Figure 16:
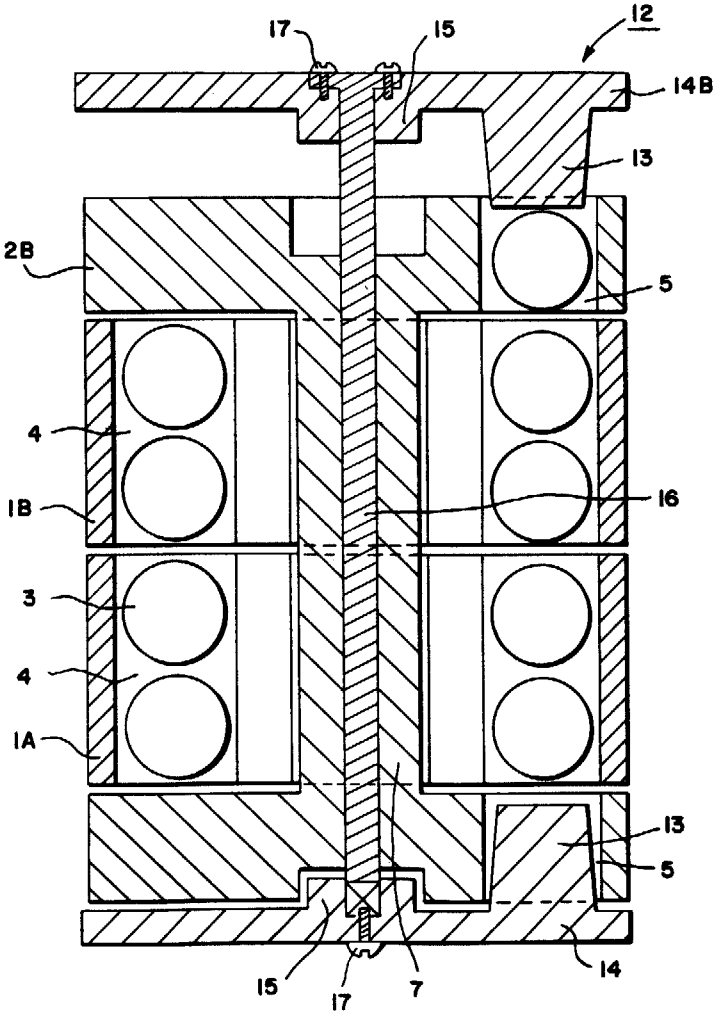

In the embodiment of FIGS. 14 through 18 in conformity to the pentagonal disposition of puzzle holes 4 and shunting holes 5 refer to FIG. 17 and FIG. 18, puzzle elements 3 are divided into five groups by colors, namely, blue, green, yellow, orange and red, and the number of puzzle elements belonging to each group is made four which is the number of puzzle elements 3 receivable in puzzle holes 4 of each group. One black puzzle element is added as a puzzle element to be inserted orginally in one of the shunting holes in pairs. Thus, the total number of puzzle elements is $5\times4+1=21$.

Explanation is made below about the movement of puzzle elements by a puzzle element shifting means 12.

Figures 20A, 20B, 20C, 20D:
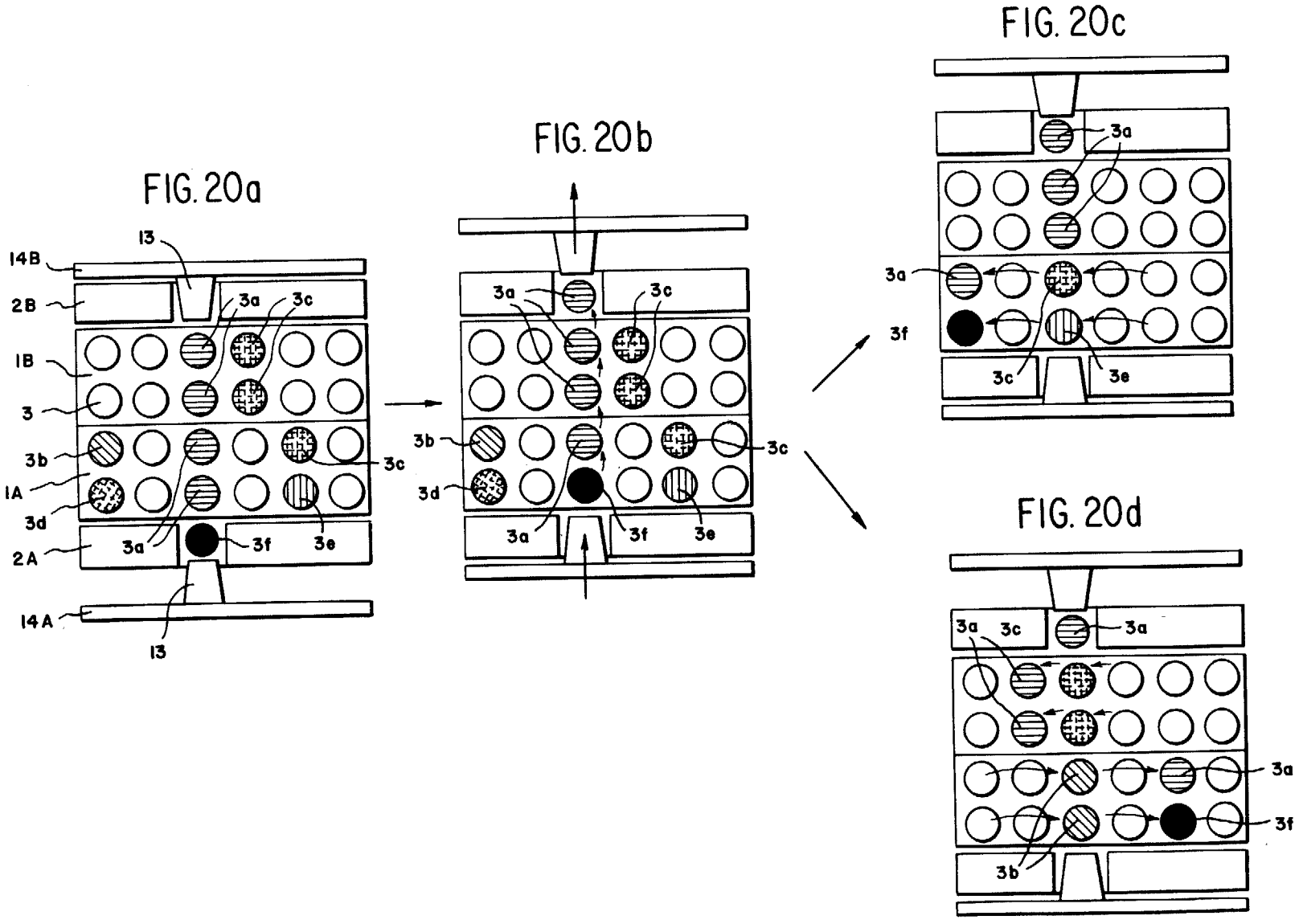

Referring to FIG. 20, in the case where a black puzzle element 3*f* exists in the lower shunting hole 5 (FIG. 20(*a*)) if the lower projection 13 is raised puzzle elements 3*a*, 3*a*, 3*a*, 3*a* in the puzzle holes 4 which communicate with the lower and upper shunting holes 5 and the puzzle element 3*f* in the lower puzzle hole 4 are also pushed upwardly by one stage and the uppermost puzzle element 3*a* enters in the upper shunting hole 5 as shown by FIG. 20(*b*).

In the state as shown by FIG. 20(*b*), if one/both of the rotary indicators 1A, 1B is/are rotated, one/two puzzle holes which aligns/align with the puzzle element 3*a* in the upper shunting hole 5 is/are changed and accordingly the disposition of puzzle elements 3 aligning with the upper shunting hole 5 is changed as shown by FIG. 20(*c*) or FIG. 20(*d*).

Then, if the upper projection 13 is pushed downwardly to shift puzzle elements in a line downwardly by one stage and one/both of the rotary indicators 1A, 1B is/are rotated, puzzle indication is changed.

Even when the arrangement of puzzle elements is designated in two directions, namely, axial direction and circumferential direction, if the relationship of arrangements in two directions is specified, for example, in the order of spectrum of blue, green, yellow, orange, and red, the completion of puzzle is of a single pattern. However, if the relationship of directional arrangement is ignored, for the completion of puzzle as many as forty-eight different patterns are available in the first embodiment. Thus, more attention will be attracted to the puzzle of this kind and the commodity value of it will be enhanced. In addition, puzzle elements can be shifted compulsorily by hands by means of a pair of puzzle elements moving means including support plates having projections or plungers while the puzzle elements are held in puzzle holes and shunting holes. Therefore, puzzle elements can be shifted easily and accurately and there is no fear of puzzle elements being lost.

The rotary drum puzzle according to the present invention includes rotary indicators having puzzle holes and shunting bodies arranged at the position communicant with said puzzle holes, each having at least two shunting holes and being rotatable relative to the rotary indicators, whereby arrangement and indication of puzzle elements in at least two puzzle holes can be changed simultaneously which is effected by shunting a puzzle element accommodated in a puzzle hole into a shunting hole and then shifting the puzzle element to the other puzzle hole. Therefore, by shifting the desired puzzle element in a puzzle hole to a shunting hole, another puzzle element in a puzzle hole which is opposing another shunting hole is shifted to the shunting hole simultaneously and thus at each change of puzzle indication, the position of puzzle elements as a whole is also changed. This makes it very difficult to solve the puzzle, in other words, making the puzzle game high level.

I claim:

1. A rotary puzzle device comprising:

a rotary indicator of drum shape having at least two puzzle holes which pass through a circumferential part of said rotary indicator in an axial direction;

a pair of shunting bodies of drum shape which are rotatable relative to said rotary indicator provided one on each side of said rotary indicator which have at least one shunting hole passing therethrough at a position corresponding with the puzzle holes of said rotary indicator;

a plurality of puzzle elements provided in said puzzle holes of said rotary indicator and in said shunting hole of one of said pair of said shunting bodies; and puzzle elements moving means comprising a pair of support discs provided one on each side of said pair of shunting bodies and projections, in the same number as the shunting holes of said shunting body, projecting toward said shunting holes of the shunting body and a shaft passing through centers of said rotary indicator and said shunting bodies coupled at each end to one of said pair of support discs, wherein the distance between projections of said pair of support discs is substantially equal to the total length of puzzle elements which are located between a pair of opposing shunting holes plus the length of one puzzle element so that when one puzzle element in one shunting hole is pushed in a puzzle hole, one puzzle element in said puzzle hole is shifted into an opposite shunting hole which is vacant.

2. A rotary puzzle device comprising:

at least one rotary cylindrically shaped indicator having at least two longitudinal puzzle holes provided therein and having a central longitudinal axis, said rotary indicator further being transparent;

a pair of shunting cylindrically shaped bodies, each of said bodies being provided on opposite sides of said rotary indicator and having a central axis which corresponds to said central axis of said rotary indicator, said bodies being rotatable relative to said rotary indicator, said bodies further being transparent;

at least one shunting hole provided longitudinally in said bodies and corresponding to said puzzle holes;

a pair of end discs each of said discs being provided on opposite sides of said shunting bodies and having a central axis which corresponds to said central axis of said rotary indicator, said discs being coupled together such that they move together and slide back and forth longitudinally of said rotary indicator and shunting bodies;

at least one projection provided on each of said end discs, a number of said projections corresponding to the number of shunting holes; and a plurality of puzzle elements provided in said puzzle and shunting holes;

whereby said puzzle elements may be moved about in said puzzle by sliding said discs back and forth and rotating said rotary indicator relative to said shunting bodies.

3. A rotary puzzle device according to claim 2, wherein said rotary puzzle device includes at least two rotary indicators having puzzle holes.

4. A rotary puzzle device according to claim 2, wherein said rotary indicator has at least three puzzle holes and the number of shunting holes of the shunting rotary body is less than that of puzzle holes of the rotary indicator at least by one.

5. A rotary puzzle device according to claim 2, wherein said puzzle holes of the rotary indicator are arranged at equal intervals.

6. A rotary puzzle device according to claim 2, wherein the rotary indicator and the shunting body are drum-shaped and puzzle holes and shunting holes are provided at the circumferential part of the rotary puzzle in axial direction.

* * * * *